United States Patent [19]

Gessler et al.

[11] 4,077,526

[45] Mar. 7, 1978

[54] SILO, ESPECIALLY FOR HEAVY FLOWING CHEMICAL AND MINERAL SUBSTANCES

[75] Inventors: Hans Gessler, Aalen; Josef Faul, Wasseralfingen, both of Germany

[73] Assignee: Schwabische Huttenwerke Gesellschaft mit beschrankter Haftung, Aalen, Germany

[21] Appl. No.: 653,445

[22] Filed: Jan. 29, 1976

Related U.S. Application Data

[63] Continuation-in-part of Ser. No. 460,611, Apr. 12, 1974, Pat. No. 3,949,888.

[30] Foreign Application Priority Data

Apr. 12, 1973 Germany ..... 2318560

[51] Int. Cl.[2] ..... B65G 65/46

[52] U.S. Cl. ..... 214/17 D

[58] Field of Search ..... 214/17 R, 17 D, 17 DA; 198/555; 222/240, 241, 273, 274, 410, 413

[56] References Cited

U.S. PATENT DOCUMENTS

| | | | |
|---|---|---|---|
| 575,550 | 1/1897 | Mathews | 193/32 X |
| 2,189,018 | 2/1940 | Robinson | 222/410 |
| 3,018,930 | 1/1962 | Hamprecht et al. | 222/410 |

*Primary Examiner*—Robert G. Sheridan
*Attorney, Agent, or Firm*—Walter Becker

[57] ABSTRACT

A silo for pourable material, especially heavy-flowing chemical and mineral substances with an upper charging station and at least one lower withdrawing station, according to which additional friction walls are in vertically spaced superimposed arrangement provided on the inner silo wall and are inclined downwardly relative to horizontal planes while being provided with passages therethrough for the passage of silo material therethrough, the angle of inclination of the friction walls being at every area thereof greater than the specific pouring angle of the respective pourable material in the silo.

3 Claims, 7 Drawing Figures

SILO, ESPECIALLY FOR HEAVY FLOWING CHEMICAL AND MINERAL SUBSTANCES

This is a continuation-in-part of co-pending parent application Ser. No. 460,611-Gessler et al. filed Apr. 12, 1974, now U.S. Pat. No. 3,949,888-Gessler, et al., issued Apr. 13, 1976.

The present invention relates to a silo for pourable materials, especially for heavy flowing chemical and mineral substances, with an upper charging station and at least a lower discharging station for the pourable material.

The flow behavior, expecially of heavy flowing materials within silos is determined primarily by the tendency of the pourable material to form bridges or domes in the interior of the silo. Various factors determine the phenomenon of the socalled bridge formation, namely, above all, the bulk weight, the water content, the particle shape, the particular size, the ahdesion ability on the silo inner wall, the silo volume, the silo cross section, the duration of the storage, etc. The mechanical basic condition for a bridge formation is, however, always a critical horizontal tension within a column of pourable material at which the individual pourable particles wedge into each other and clamp against each other.

The horizontal tension within a column of pourable material is, in view of the liquid-like behavior of the pourable material, a function of the vertical tension within such column of pourable material. Therefore, the horizontal tension and thus the danger of a bridge or dome formation can favorably be influenced by reducing the vertical tension. The vertical tension is, in addition to the bulk weight and the filling height dependent primarily on the co-efficient of friction between the pourable material and the inner wall of the silo.

It is an object of the present invention with a silo of the above mentioned general type to provide for a trouble-free withdrawl of the stored pourable material and in this connection to avoid the formation of domes in the interior of the silo and furthermore also with the heavy flowing silo material to avoid high occurring forces.

These and other objects and advantages of the invention will appear more clearly from the following specification, in connection with the accompanying drawings, in which.

Figure 3:
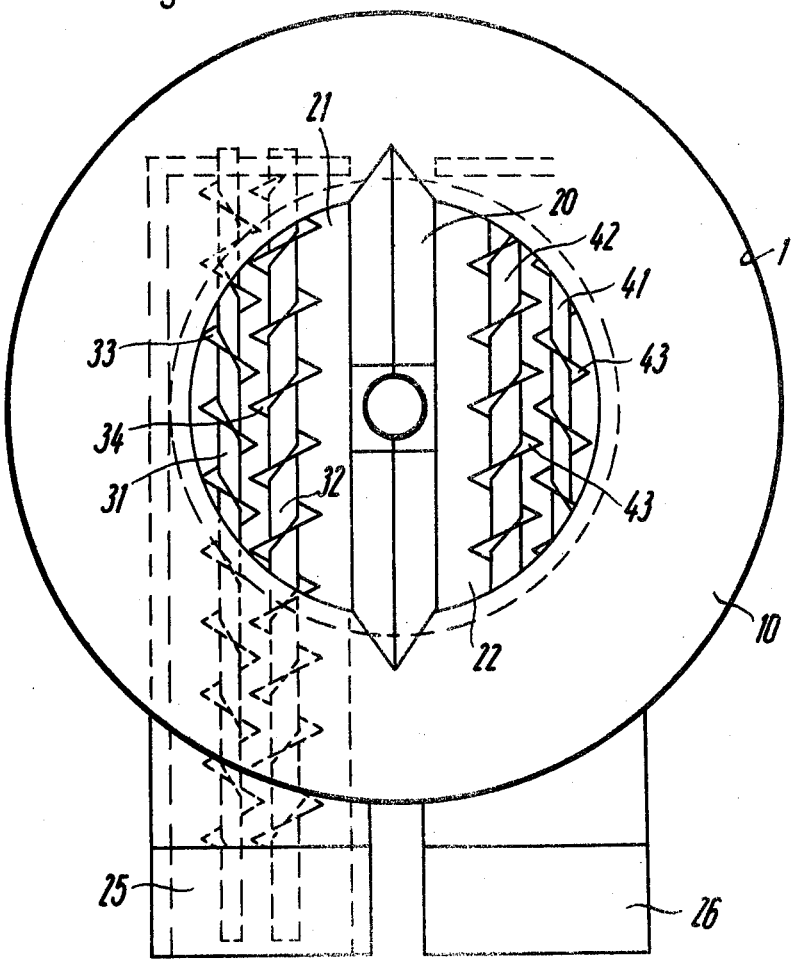
FIG. 3 is a horizontal section taken along the line A—A of FIG. 2.

FIGS. *3a,3b,3c* and *3d* show modifications of silo structure of FIG. 3.

The silo according to the present invention is characterized primarily in that on the silo inner wall there are provided in superimposed arrangement additional frictional walls which are inclined relative to the horizontal plane and which form passages for the silo material, the angle of inclination of said friction walls exceeding the specific pouring angle of the pourable material in order to assure a pouring movement everywhere.

In this way, a considerable portion of the weight of the pourable material is introduced directly into the silo mantle through the friction walls serving as guiding surfaces. As a result thereof, in the lower portion of the column of pourable material, the vertical tension will at least approximately equal the vertical tension in the lower regions of the silo, whereas without the inserts according to the invention, the vertical tension will, in conformity with the height, increase below the upper edge of the filling material, in conformity with an e-function. This reduction in the vertical tension simultaneously brings about a reduction in the horizontal tension so that by employing the present invention, the tendency to form bridges can be reduced to such an extend that the danger of the formation of domes will be eliminated. Moreover, in view of the invention, a reduction in the static pressure in the withdrawing range of the silo is reailized whereby the mechanical withdrawing elements are relieved and a dosed controllable withdrawal of the pourable material will be possible in a simple manner. By employing inclined friction walls extending around in a closed manner, which friction walls are provided with passages therethrough, the pressure of the silo material generates pull tensions in the wall portions, which said wall portions, due to their rigidity, will be able safely to absorb without additional supports, even with heavy flowing materials and thus high forces.

In a particularly preferred design of the present invention, the area of the least inclination of the friction walls exceeds the specific pouring angle of the pourable material only to such an extens as is necessary for safely maintaining a flow-free gravitation flow, preferably by from approximately 5 to 20%, in the case of particularly heavy flowing materials up to approximately 40%. In this way the angle of inclination of the guiding surfaces formed by the friction walls with regard to the horizontal is as large as possible in order to prevent an effective brake friction upon the pourable material, but on the other hand, the angle of inclination is sufficiently less than the specific pouring angle in order to prevent a settling of the particles of the pourable material on the friction walls.

According to an embodiment of the invention which is particularly favorable from a manufacturing standpoint, the friction walls are, particularly with a silo of cylindrical cross section, designed in the manner of walls of a cone with the cone tips adjacent to the discharging opening cut off. This will, in a simple manner, permit that the openings of the friction walls formed preferably by cutting off the imaginary cone tips or with a silo with rectangular cross section cutting off the imaginary pyramidal tips, be arranged so that their central axes are laterally offset with regard to each other. Due to this lateral offsetting, the so-called core flow will be prevented, which might otherwise cause a de-mixing of a mixture of pourable materials.

Advantageously, in this connection, the central axes of the openings of the friction walls are laterally offset with regard to the silo axis. Preferably, this is done in such a way that the central axes of the passages in the friction walls are distributed over the circumference of an imaginary circle surrounding the silo axis. In this way, it will be possible to design the friction walls similarly or equally while, nevertheless, due to their different locations also to generate horizontal flow movements within the silo. This brings about an activity within the entire column of pourable material. Without additional parts, such activity within the column of pourable material will be further increased by the fact that the friction walls, advantageously form parts of such imaginary cones or pyramids, the main axis of which, form an angle with the silo axis, and according to a further development of the invention are located in a windtipped manner (windschief) with regard to the silo axis. In this way, different angles of inclination of the friction walls will be generated which in turn brings about different local velocities in the horizontal as well as in the vertical plane and in combination with the offset arrangement of the passages toward the respective next lower axial zone will assure a high activity within the column of pourable material.

A follow-up flowing of the pourable angle which will at any rate be proper and free from disorders will be assured without additional steps by the fact that the diameter of the passages in the friction walls exceeds that critical discharge diameter of the respective pourable material from which on the flow of gravitation occurs.

Advantageously, the number of the friction walls to be built into a silo is while maintaining a good flow behavior reduced by the fact that the distance of the superimposed friction walls is with a higher specific bulk weight of the pourable material less and with a lower specific bulk weight is higher. In this way it will be assured that on one hand, with pourable material having a high specific bulk weight, a sufficient reduction in the vertical tension will be realized in order safely to avoid a bridge formation. On the other hand, however, with pourable material of a lower specific bulk weight, a satisfactory flow behavior will be assured while in addition thereto, unnecessary manufacturing expenses by insertion of such a number of friction walls will be prevented which, in this instance, with higher mutual distance, in view of the lower pressure load of lower pouring zones will bring about a sufficient reduction in the vertical tension.

An important advantage of the present invention is seen in the fact that the mechanical withdrawing elements are relieved from static pressure so that a dosed controllable withdrawal at low cost can be assured. Advantageously, to this end, the withdrawal of pourable material is effected through preferably a central conical or pyramidal discharge funnel. Also, in this instance, an accumulation of particles of pourable materials on the funnel walls will advantageously be avoided by the fact that the inclination of the funnel walls, for assuring the movement of the pourable material, exceeds the specific pouring angle of the pourable material. A considerable relief of the mechanical withdrawing elements at the lower silo end and also a withdrawal of the silo material at will can be realized by the fact that the withdrawal cross section is less than the critical discharge cross section from which on gravitational follow occurs. Thus, for obtaining a dosed withdrawal in the discharge funnel, a vertical withdrawal worm is provided. This withdrawal worm advantageously extends into the region of the inlet opening of the discharge funnel in upward direction and thus catches the pourable material collected in the discharge funnel substantially over the entire height of said funnel. This, in turn, brings about in the interior of the funnel a defined movement of the pourable material in downward direction in the vicinity of the central withdrawal worm while during the withdrawal, to the extent to which the material is being withdrawn, material from above or the side will follow while, however, no core flow occurs which could bring about a de-mixing. The withdrawal volume of the worm per time unit is effected at a fixed ratio to the quantity of pourable material, which quantity follows and flows from the upper silo portion into the discharge funnel and finally leaves the silo. Thus, the withdrawal quantity can be precisely dosed, which means in conformity with the speed of rotation of the vertical withdrawal worm arranged in the discharge funnel.

Advantageously, the withdrawal worm is by the discharge opening of the discharge funnel surrounded with considerable play. The effective cross-sectional surface of the withdrawal worm amounts as to that portion which is located at the level of the discharge opening to preferably less than 1/5 of the discharge cross section of the discharge funnel. Due to this step, the load acting on the withdrawal worm is further reduced because its drive not only does not have to permit a positive automatic emptying, but rather the worm will, during its rotary movement, impart upon the pourable material in the discharge funnel merely a component of force which is superimposed upon the force of gravity and assures the outflow movement at least in the direct vicinity of the conveyor worm. In this connection, an equalization of the exertion of pressure of the withdrawal worm upon the pourable material is advantageously realized by the fact that the effective cross-sectional surface of the withdrawal worm increases in the direction toward the larger entrance opening of the discharge funnel. In particular, with such silo material the particles of which have the tendency to interhook and interwedge, it will additionally be assured that the withdrawal worm will not idly rotate in the resting material in the discharge funnel. Due to the downwardly decreasing conveying surfaces of the withdrawal worm, the respective upper worm winding will press a greater quantity of silo material in downward direction than can be received by the lower worm winding so that at any rate a flow movement of the material to be conveyed is forced in the immediate vicinity of the worm which grasps or catches the adjacent silo material and thus prevents an idle rotation of the worm. Inversely, also a decrease in the effective cross-sectional surfaces of the withdrawal worm in the direction toward the inlet opening of the discharge funnel may be advantageous, particularly when in view of the consistency of the pourable material an idle moving of the worm is not to be expected because as a result thereof the lower worm windings which are pressure loaded in view of the reduced cross section of the discharge opening have the larger surface and thus the withdrawal worm is additionally relieved from vertical pressures. It is a matter of course that such changes of the effective cross-sectional surfaces of the withdrawal worm may also be effected in a non-continuous manner.

In this way, by means of a rotatable withdrawing worm, which freely rotates in a funnel of relatively short height and which is exposed to only very low force and pressure effects, a well-dosable discharge from the silo will be realized. In this connection, it is advantageous that the discharge opening in downward direction is limited by a rotatable plate which cooperates with stripper elements and conveying elements for conveying the material from the silo. Also, the rotatable plate as, in view of the relatively small cross-sectional surface of the discharge opening for the pourable material, above all, however, by the considerable relief from pressure of the upper regions of the column of pourable material under such a load that also its drive and mounting does not require great expenses. The direction of rotation of the rotatable plate is advantageously variable whereby it is possible to influence the quantity to be stripped off. When stopping the withdrawal worm and the rotatable plate, the mass flow stops automatically without in view of the discharge diameter preventing or interfering with the gravitational flow and also without such a standstill, causing the withdrawal worm or the rotatable plate to have to absorb the full pressure of the column of pourable material.

It will thus be appreciated that silos of the type according to the invention can be designed rugged and thus safe in operation. The only movable part in the pourable material is the withdrawal worm which, however, is only under a predetermined partial load of the column of pourable material and which with a relatively small diameter requires a relatively low driving moment. Thus, silos of the type according to the invention are characterized by a low wear, low installed output and high safety of operation. The danger of a bridge or dome formation which would negatively influence all succeeding processes is eliminated in a purely static manner without the employment of expensive movable parts liable to disorder.

Figure 1:
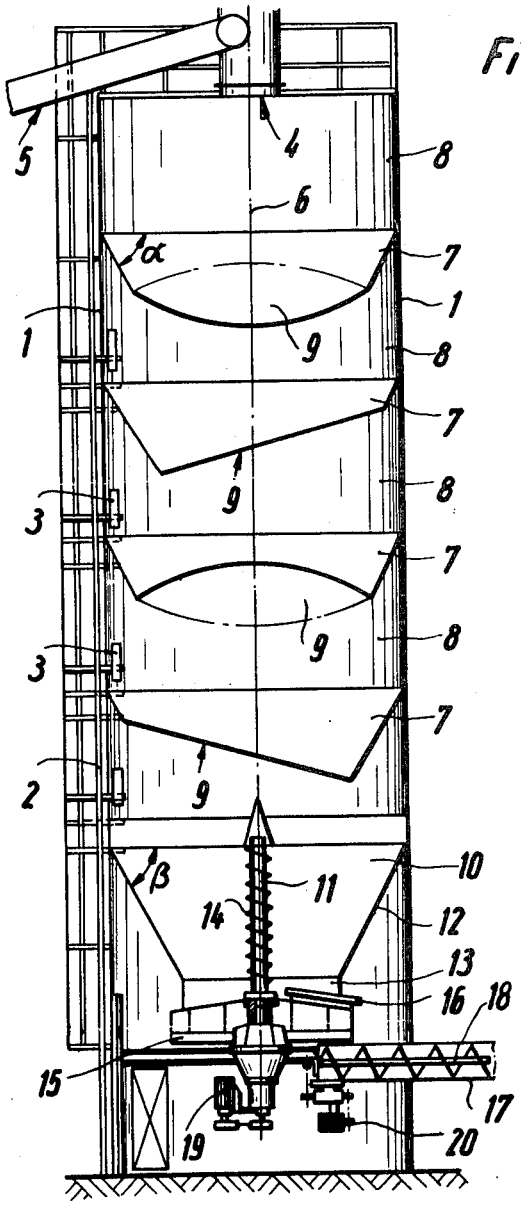
FIG. 1 illustrates a vertical section through a first embodiment of a silo according to the invention.

Referring now to the drawings in detail, the silo illustrated in FIG. 1 has an inner wall of circular cross section. For purposes of servicing the silo, one side of the silo is provided with a ladder 2 from which doors 3 leading into the interior of the silo are accessible. At the bottom side of the silo there is provided a charging station 4 for the pourable material which charging station is charged by a conveyor belt 5. The opening at the charging station 4 for charging therethrough the pourable material into the silo is in this particular embodiment arranged in the upper silo end wall and, more specifically, centrally with regard to the silo axis 6.

In the interior of the silo there are arranged superimposed to each other friction walls 7 which divide the interior of the silo into axial zones 8. A transfer of the pourable material from zone to zone is made possible by the passages or openings 9 in the friction walls 7, the central axes of which are offset with regard to each other to avoid a core flow. This offset arrangement is in this particular embodiment realized by having the friction walls 7 designed as truncated cone-mantle surfaces, while the cone-axes coincide with the silo axis and the imaginary downwardly pointed tips of the cone are cut off at an angle with regard to the axis of the cone. Such offset arrangement of the central axes of the passages 9 in the friction walls 7 may be realized in various manners, for instance, by inserting truncated cone-mantle surfaces with cone axes which are inclined to the silo axis 6 or are wind-tipped relative thereto. Over a completely asymmetric shape, a design of the friction walls 7 as portions of cone-mantle surfaces has the advantage of a simplified manufacture. At any rate, however, equal friction walls 7 can be employed by turning the walls with their eccentric passages therethrough relative to each other so that the central axes of the openings are distributed over the circumference of an imaginary circle surrounding the silo axis and, if desired, extend at an angle to the silo axis or in a wind-tipped manner thereto.

By means of the friction walls 7 acting as guiding surfaces, a portion of the weight of the pourable material is directly introduced into the silo side walls 1 so that the lower layers of material are relieved from the weight of the column of material. In this connection, it will be appreciated that the friction walls 7, due to their closed circular design, are able to absorb the high forces which occur in particular with heavy flowing silo material, without the necessity of providing additional supports. It will thus be evident that the vertical tensions caused by the weight of the column of material is reduced which, in turn, results in a reduction of the horizontal tensions and thus of the tendency to form bridges. To this end, the inclination of the friction walls 7 (angle$\alpha$) relative to the horizontal plane can be held small. In order, on the other hand, to assure a safe sliding of the pourable material from the intermediate walls, the said inclination is so selected that it sufficiently exceeds the specific pouring angle of the pourable material.

With the specific embodiment shown in FIG. 1, the pourable material is passed downwardly along an approximately spiral path in the silo. At the lower end of the silo, the pourable material enters a discharge funnel 10 in which in the illustrated manner a vertical withdrawal worm 11 driven by motor 19 is provided. Also the side walls of the discharge funnel 10 are inclined by an angle $\beta$ which exceeds the pouring angle of the material so that no accumulations of the pourable material will form on the side walls 12 which do not slide off. However, while the passages 9 in the friction walls 7 are selected so great that the diameter thereof exceeds the critical discharge diameter of the respective pourable material from which critical discharge diameter on gravitation flow occurs, the diameter of the lower discharge opening 13 of the discharge funnel 10 is for preventing an outflow also without the aid of the discharge worm 11 kept on one hand so small that its diameter is less than the critical outflow diameter of the respective pourable material, but on the other hand is so great that with the aid of the discharge member a trouble-free withdrawal of the pourable material at the desired doses will be assured. During the discharge, the discharging worm 11 grasps the pourable material in the discharge funnel 10 by means of its conveying surfaces 14 which widen in upward direction, and creates in its vicinity a flow movement in downward direction toward the discharge opening 13. In this connection, the downwardly conveyed pourable material is at the pressure of the column of pourable material thereabove replaced by the pourable material in the discharge funnel 10 while pourable material from above flows by gravity flow through the openings 9 in the friction walls 7. To the same extent to which silo material is conveyed downwardly by the discharge worm 11, thus, a flow of silo material occurs into the vicinity of the conveyor worm 11 and into the discharge funnel 10, while, however, no core flow occurs which could bring about a demixing.

Silos of this type can be designed rugged and thus safe in operation. This also applies when, for instance, for improving the control, the turntable 15 is driven independently of the discharge worm 11 and a stripper 16 is provided for cooperation with the turntable 15 as shown in FIG. 1. The only movable part in the column of pourable material is the discharge worm 11 which, however, is subjected to only a predetermined partial load of the column of pourable material while said worm with a relatively short diameter requires a relatively low driving torque.

Inasmuch as also the turntable 15 is subjected to a predetermined partial load of the column of pourable material, also in this instance, the required axial loadability and the driving torque remain within certain limits.

Turntable 15 discharges to conveyor worm 18 in tube 17 driven by motor 20.

Figure 2:
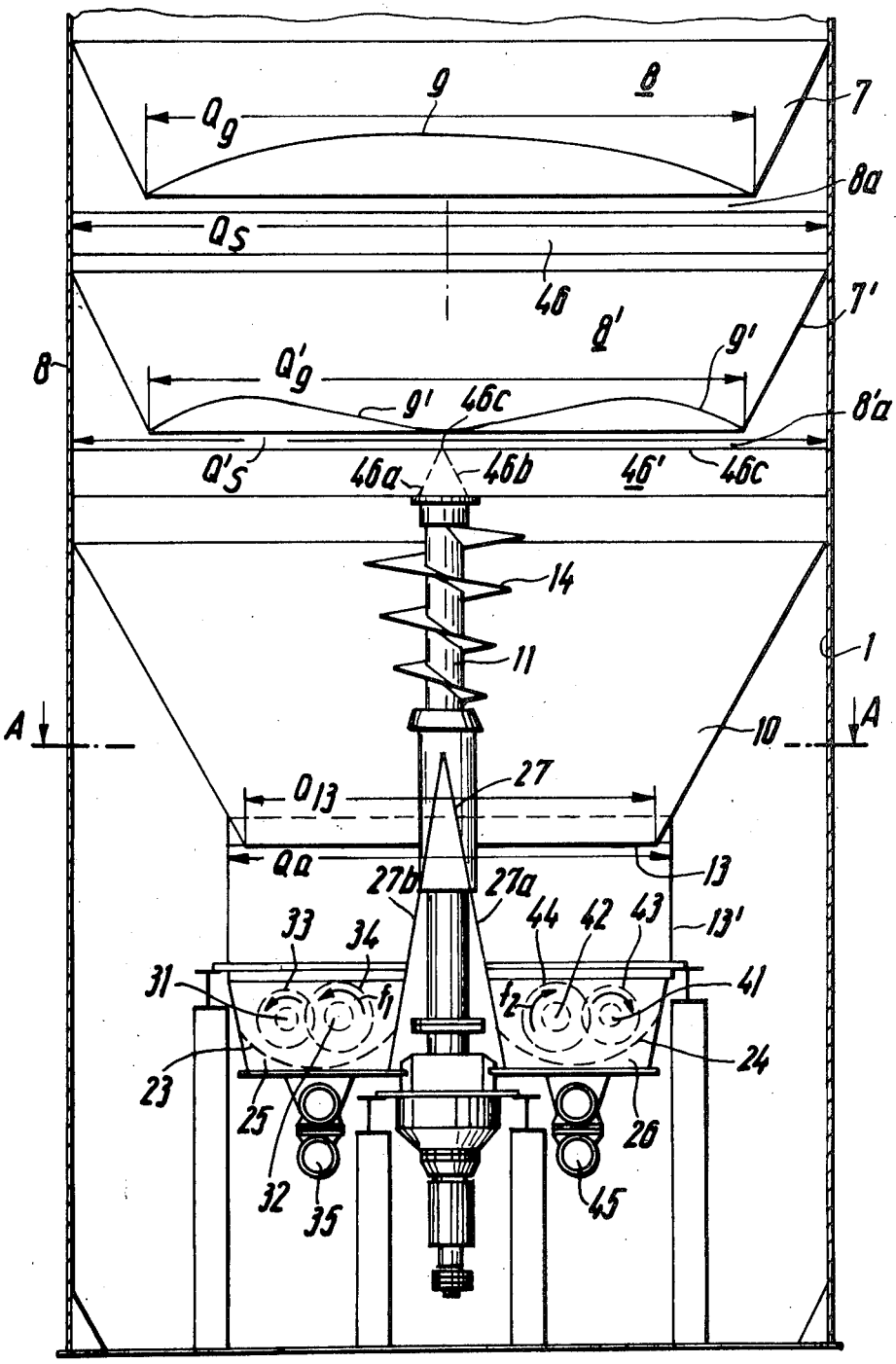
FIG. 2 is a vertical section through a modified silo according to the invention with two horizontal pairs of worms for discharging the stored material.

Referring now to FIGS. 2 and 3, those parts which correspond to the above discussed parts in FIG. 1 have been designated with the same reference numerals as in FIG. 1. The silo illustrated in FIGS. 2 and 3 is of a cylindrical shape. Its horizontal inner wall which, according to FIG. 3, has a circular horizontal section is designated with the reference numeral 1. However, the silo may also have other cross-sectional shapes, for instance, a polygonal shape. At the non-illustrated upper side of the silo there is provided a discharge station for the pourable material, which discharge station is charged by a non-illustrated conveyor belt. This discharge station is for the entry of the pourable material into the silo provided with an opening in the upper silo and wall, said opening being centrally arranged with regard to the silo axis 6.

In the interior of the silo there is provided a plurality of superimposed friction walls 7 which may be round or polygonal and of which in FIG. 2 only two superimposed friction walls 7, 7' are illustrated. The inner chamber of the silo is by the friction walls divided in axial zones 8, 8' (so-called compression zones) which are followed by a relief or detentioning zone 8*a*, 8'*a* with a greater cross section than the compression zone 8, 8'. The transfer of the pourable material from zone 8 to zone 8*a* is made possible by the passages 9, 9' in the friction walls 7, 7'. The central axes of the passages may be offset with regard to each other for purposes of avoiding a core flow.

When viewed over the height of the silo, according to the present invention the cross sections $Q_9$ of the passages 9 are smaller than the following free cross section $Q_s$ into which the material passes after it has flown through the opening 9. This also applies to the cross section $Q_{13}$ of the discharge opening 13 of the discharge funnel 10 which is smaller than the next following cross section $Q_a$ at the entry of the material into the receiving container 13' therebelow.

When the material passes those regions 8, 8' of the silo which are defined by the frictional walls 7, 7', the material will be compacted in view of the smaller passages or cross sections in the zone 8, 8' while additionally the walls 7, 7' respectively act as friction brakes. At the same time, the weight of the column of material is relieved in vertical direction because the friction walls 7, 7' absorb a considerable proportion of the bulk weight and directly convey the same to the silo wall. In this way, the material below each friction wall 7, 7' is relieved from the full weight of the material thereabove. In this connection, it is advantageous that the friction wall 7, 7' is designed as a ring or polygon closed in itself. In this way, the pull stresses which occur when the friction walls 7, 7' are under the load of the weight of the material are equalized over the entire circumference of each friction wall 7, 7' and are conveyed as forces uniformly acting upon the silo wall 1.

When the compacted material passes through the respective passage, for instance, 9, 9', defined by the friction walls 7, 7', the material relaxes, inasmuch as it, directly after leaving the passage 9, 9', passes into the enlarged cross-sectional zone 8*a*, 8'*a*. Inasmuch as the material can expand in this larger space, its direction of movement will change at least partially thereby causing its adhesive forces to break up. For purposes of aiding this break-up effect or relaxation, or for changing the direction of flow of the material, horizontal or inclined transverse beams 46, 46' may be provided below the passages 9, 9' upon which the material falls. The transverse beams 46, 46' preferably have roof-shaped sliding surfaces 46*a*, 46*b* on which the material after being divided up by the ridge 46*c* flows in different direction. For purposes of increasing this displacement effect, the beams 46, 46' may, when viewing in the direction of the silo axis, preferably be offset with regard to each other by 90°. Furthermore, in a relaxation zone 8, 8*a*, two or more beams crossing each other may be provided also in different shape. According to the present invention, it is expedient in each instance when viewed over the height of the silo the exit cross section $Q_9$, $Q'_9$ of the passages 9, 9' is less than the free receiving cross section $Q_s$, $Q'_s$ of the silo space, which free receiving cross section $Q_s$, $Q'_s$ is in the direction of movement of the silo material adjacent to said passages 9, 9'.

The transverse beams 46 provided according to the present invention will, in particular, with the cross-shaped arrangement relieve the discharge device below the silo, and preferably over the entire height of the silo, the described compression zones 8 and relief zones 8*a* and/or transverse beam 46 may be alternately arranged.

With the embodiment shown, the pourable material will, in view of the differently sized inclination surfaces within one and the superimposed frictional walls 7, 7' be moved downwardly at different flow velocity. This brings about that the so-called core flow is counteracted and it will be avoided that the pourable material will move downwardly only in the center of the silo. The silo material is rather approximately uniformly transported over the respective horizontal cross section of the silo. In this connection, it is advantageous that differently sized and differently directed horizontal transverse thrusts of the material occur which counteract the undesired core flow.

In the lower region, the pourable material enters a discharge funnel 10 in which a central vertical withdrawal worm 11 is arranged. The cross section $Q_{13}$ of the withdrawal opening 13 of the discharge funnel 10 is, according to the invention, smaller than the cross section $Q_a$ of the adjacent receiving container 13' so that also in this instance, when the material leaves the discharge funnel 10 and enters the cylindrical container 13' a relief of the material occurs. The side walls of the discharge funnel 10 similar to the friction walls 7, 7' have an inclination which exceeds the pouring angle of the pourable material so that no deposits can form on the side walls of the discharge funnel 10, but the pourable material slides off directly.

During the discharge, the withdrawing worm 11 catches the pourable material in the discharge funnel 10 and does so with its upwardly widening conveying surfaces 14, while generating in its vicinity a flow movement which is downwardly directed toward the discharge direction 13. The conveyed pourable material which is moved downwardly due to the pressure of the column of pourable material thereabove is replaced by the pourable material in the discharge funnel 10 while from above material flows by gravitation through the openings 9 in the friction walls 7. In this connection, however, no core flow can occur which could bring about a de-mixing of the pourable material. Advantageously, the withdrawal worm 11 is additionally mounted in its upper range in the transverse beam 46 so that this transverse beam will be able to absorb possible lateral forces acting upon the withdrawal worm.

For purposes of improving the withdrawal, the downwardly flowing flow of pourable material is divided up by a transverse strut 27, which in a roof-shaped manner tapers in upward direction at an acute angle, and is conveyed to two or more opening segments 21 and 22 (FIG. 3). Below these opening segments there is provided one or two worm troughs 23, 24 which respectively pertain to two withdrawal passages 25, 26.

In the left trough 23 there is located a pair of conveyor worms 31 and 32 which are arranged one below the other in a common horizontal plane and are parallel to each other. The worm spiral 33 of the worm 31 has the same pitch as the worm spiral 34 with which the outer edge of the worm spiral 34 describes a cylindrical mantle having a somewhat larger diameter than that of the worm 31 which is smaller in diameter. Such an arrangement brings about that the larger worm 32, 42 takes over the main conveying operation whereas the worm 31, 41 meshing with the larger worm continuously removes or strips off matrrial which may stick to the worm spiral of the larger worm. In view of the same pitch of the worms, the two conveyor worms 31 and 32 may be directed so close to each other that their worm spirals 33 and 34 mesh with each other the full depth. Since both worms are driven in the same direction of rotation and at the same speeds of rotation, a self-cleaning effect of both conveyor worms 31 and 32 over the total passage cross section is obtained. Furthermore, when viewed in the direction of rotation indicated by the arrows $f_1$ and $f_2$ of FIG. 2, the conveyor worm 32 is driven in counterclockwise direction $f_1$, in other words away from the wall 27*b* and the conveyor worm 42 is driven in clockwise direction ($f_2$) likewise away from the adjacent wall $2C_a$. In this way, it will be prevented that material can jam between the walls 27*a*, 27*b* and in worms 42, 32 adjacent to said walls 27*a*, 27*b*. The drive for the pair of conveyor worms 31, 32 located on the lefthand side of the discharge worm 11 is effected by an electric motor 35 through the intervention of a shaft which is common to both conveyor worms 31, 32, but is not illustrated in the drawing.

In an image-symmetrical arrangement with regard to both conveyor worms 31 and 32, and below the second opening segment 22 there is provided a second preferably equally designed and equally arranged pair of conveyor worms 41 and 42 with which also the worm spirals 43 and 44 have the same pitch. The conveyor worm 42, which has the greater diameter, is similar to the further outwardly located conveyor worm 41 of smaller diameter driven by a common drive motor 45.

In view of the two conveyor worm pairs 31, 32; 41, 42, not only a clogging-free withdrawal will be assured at the withdrawal opening, but it will also be assured that the flow of pourable material is uniformly distributed over the two discharge passages 25, 26. This makes it possible to discharge even very heavy flowing pourable material with a sticking inclination and to do this with precisely dosed quantities.

The views of FIGS. 3*a*, 3*b*, 3*c* and 3*d* concern modifications of the features of the previous FIGS. 1 and 3 using reference numeral designation with single or primes thereafter to indicate comparable structural features. In place of a round or cylindrical silo mantle, there is provided with these modifications an angular mantle whereby as an example four corners become utilized. As a practical matter, there is to be noted that also a different number of corners can become provided including, for example, hexagonal as well as other polygonal configuration.

Figure 3B:
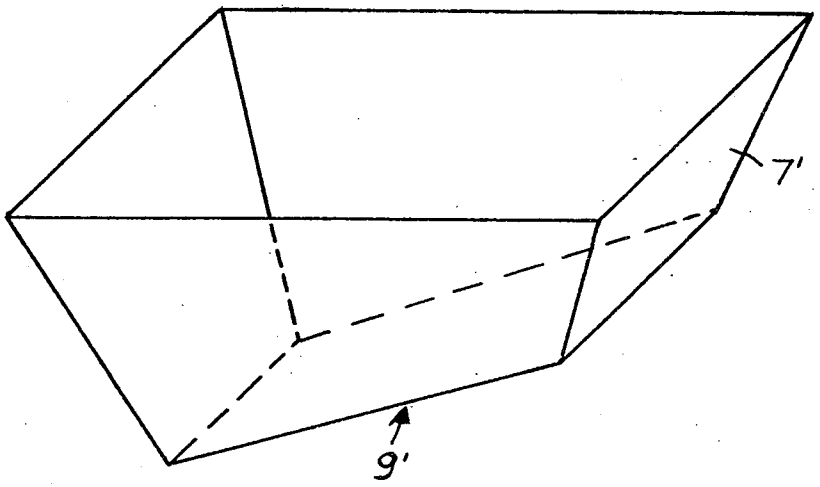
Figure 3A:
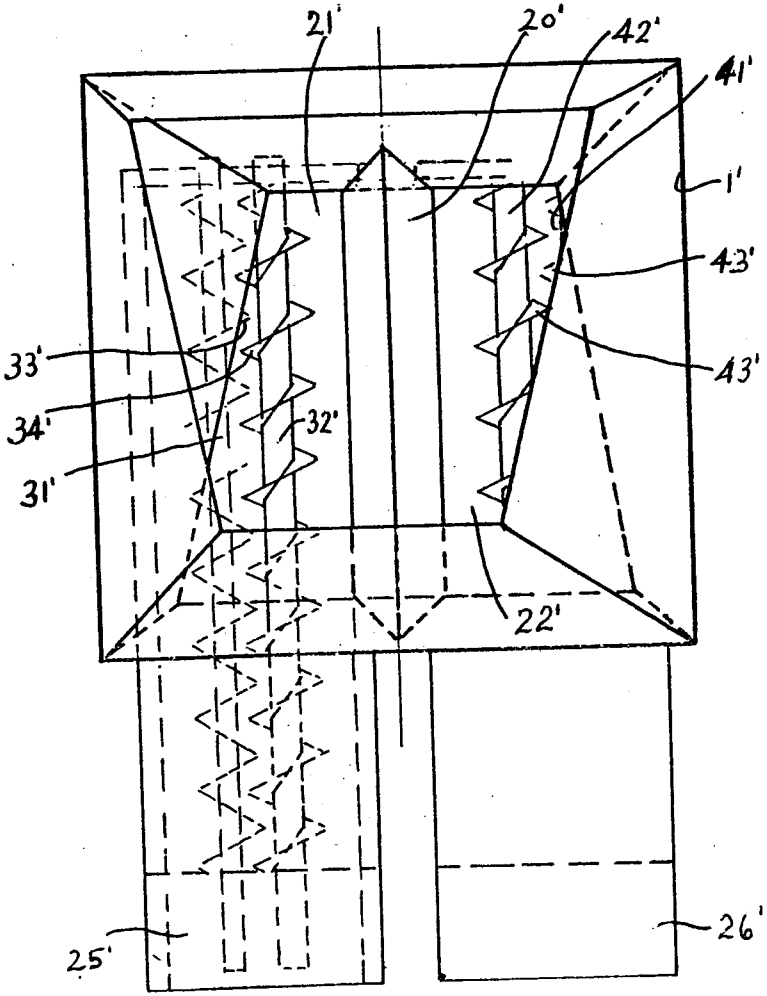
Figures 3C, 3D:
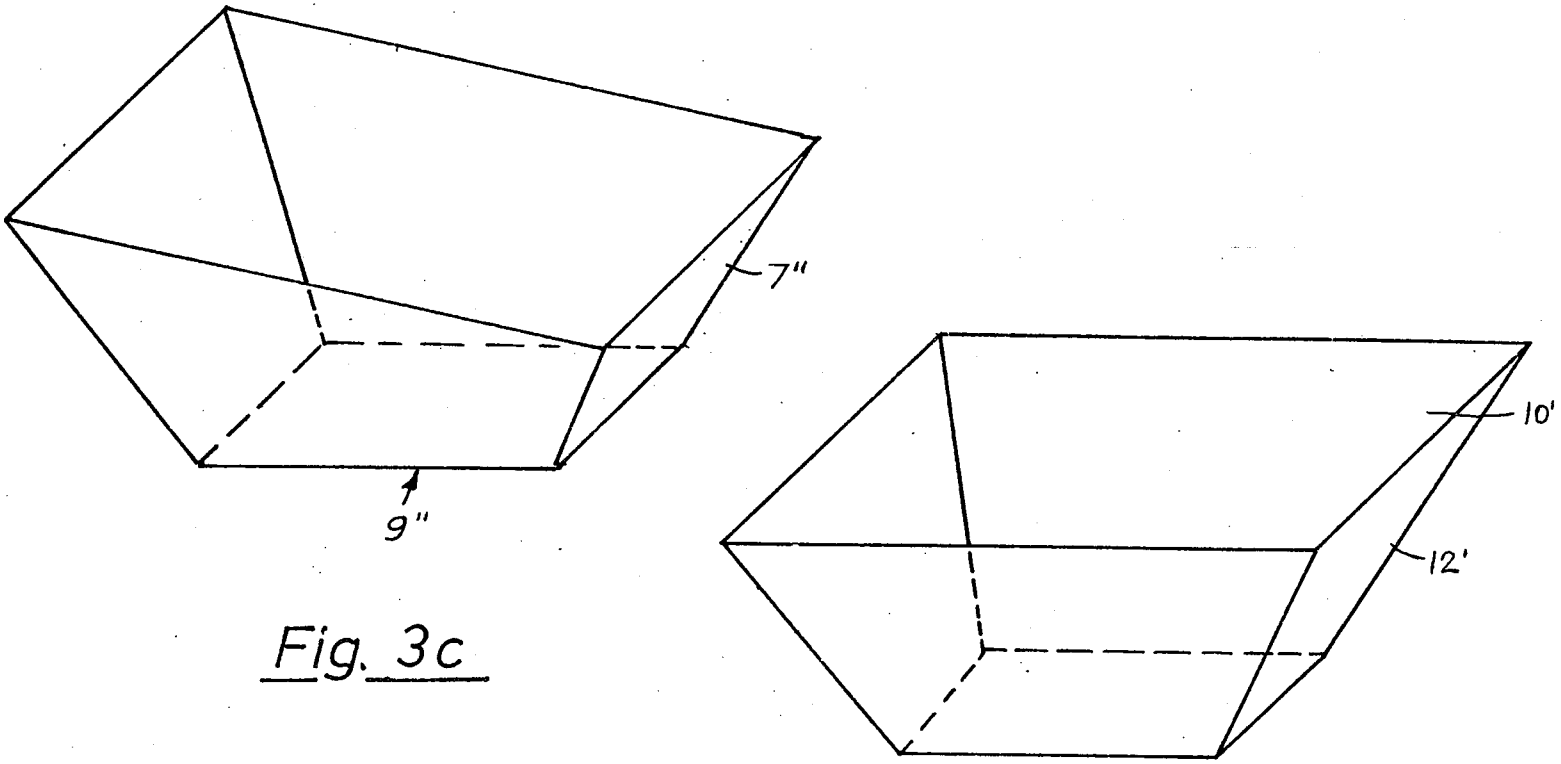

FIG. 3*b* is a schematic view of a downwardly tapering built-in portion of friction walls 7, 7' recognizable in FIG. 2 and in FIG. 1 and more detailed formation thereof is provided by the view of FIG. 3*b*. The side walls of this built-in portion represent braking walls which bring about that the material after discharge therefrom into the further cross sectional chamber below these built-in walls 7 can enter so that inner tensions or stress in the material which would lead to bridge formation can become relieved and are eliminated. The remaining sample embodiment illustrations of FIGS. 3*c* and 3*d* show other possible forms or configurations of such built-in wall structures which, however, always have the same technical purpose and which have the technical effect described in detail in the specification.

With a non-round or non-circular embodiment of the silo mantle, there is noted that the inserts also are provided with a form matched or adapted with respect to the silo cross section and in the present situation accordingly there would be four corners. In a purposeful manner as with the conical rings having a truncated cone-type form, there becomes provided unsymmetrical arrangement of inclined sides resulting with these inserts whereby at least one inclined side provides a different angle and/or a different side length than provided by the remaining sides.

According to FIG. 3*b*, the foregoing becomes attained thereby that truncated-pyramid-formed funnel means become installed in a silo mantle in such a manner that the larger base surfaces located above represent horizontal planes with respect to the silo axis and that the smaller base surfaces located below are located in inclined positions with respect to the horizontal plane.

According to FIG. 3*c*, the inserts are so modified that the larger surfaces located above have a crooked angle or incline to the silo axis while the smaller base surfaces located below are provided in the horizontal plane. Also with this embodiment the inclination angle differs and/or the length of at least one side surface differs with respect to that of the remaining side surfaces of the funnel means.

According to FIG. 3*d*, there is to be noted that both face surfaces of the truncated-pyramid-formed funnel means are parallel to each other while the inclination angle of at least one side surface differs with respect to that of the remaining side surfaces of the funnel means.

Furthermore, there must be noted that combinations of features illustrated by FIGS. 3*b*, 3*c* and 3*d* are possible. For this reason, the polygonal relationship thereof is to be noted particularly. In all cases, there becomes attained that the friction values between the silo material and installed bodies are of different magnitude along different sides in a manner similar to that with the installed bodies with round or cylindrical cross section. The purpose of this measure is to maintain active the entire pouring material column and to avoid core flow in a manner similar to that with the installed bodies with round or cylindrical cross section.

The installation of truncated-pyramid-formed funnel means arranged one above the other occurs in such a manner that the differently effective braking surfaces or friction surfaces are displaced in any event with respect to each other and at least relative to individual insert bodies.

There can be noted a combination of vertical worm and conical ring arrangement as inserts.

It is, of course, to be understood that the present invention is, by no means, limited to the specific showing in the drawings but also comprises any modifications within the scope of the appended claims.

We claim:

1. A silo for pourable materials which has an inner wall and an upper portion and a lower portion, especially for heavy-flowing chemical and mineral substances, which includes in combination: a charging station arranged at said upper silo portion for charging pourable materials into said silo, at least one discharge station arranged at the lower silo portion for withdrawing pourable material from said silo, a plurality of friction walls arranged in vertically spaced superimposed position and mounted on said inner wall, each of said friction walls extending all the way around said inner wall while being provided with passage means therethrough for pourable materials to flow from said charging station to said discharge station, said friction walls being inclined in the direction toward said lower silo portion at an angle of inclination relative to horizontal planes which is greater than the specific pouring angle of the pourable materials to be passed through said silo, a discharge funnel arranged in said lower silo portion and having inclined walls the angle of inclination of which relative to the horizontal plane exceeding the specific bulk weight angle of the pourable material to be passed through said silo, said funnel being provided with an upper inlet opening and a lower outlet opening, vertical withdrawing means extending through said inlet opening into said funnel, variable speed motor means drivingly connected to said withdrawing means, said withdrawing means extending up to the region of said inlet opening of said funnel, said withdrawing means being surrounded with considerable play by said outlet opening of said funnel so that the effective cross sectional surface of said withdrawing means at the level of said outlet opening is less than one fifth of the cross section of said outlet opening.

2. A silo for pourable materials which has an inner wall and an upper portion and a lower portion, especially for heavy-flowing chemical and mineral substances, which includes in combination: a charging station arranged at said upper silo portion for charging pourable materials into said silo, at least one discharge station arranged at the lower silo portion for withdrawing pourable material from said silo, a plurality of friction walls arranged in vertically spaced superimposed position and mounted on said inner wall, each of said friction walls extending all the way around said inner wall while being provided with passage means therethrough for pourable materials to flow from said charging station to said discharge station, said friction walls being inclined in the direction toward said lower silo portion at an angle of inclination relative to horizontal planes which is greater than the specific pouring angle of the pourable materials to be passed through said silo, a discharge funnel arranged in said lower silo portion and having inclined walls the angle of inclination of which relative to the horizontal plane exceeding the specific bulk weight angle of the pourable material to be passed through said silo, said funnel being provided with an upper inlet opening and a lower outlet opening, vertical withdrawing means extending through said inlet opening into said funnel, a turntable, variable speed motor means drivingly connected to said turntable, said turntable limiting said discharge opening, stripper means for cooperation with said turntable, and conveyor means operatively connected to said silo below said funnel for conveying pourable material discharged by said silo.

3. A silo in combination according to claim 2, wherein said motor is common to said withdrawing means and said turntable for driving both said withdrawing means and said turntable.

* * * * *